US012781746B2

(12) United States Patent
Huang et al.

(10) Patent No.: US 12,781,746 B2
(45) Date of Patent: Nov. 3, 2026

(54) CO-ROTATING SCROLL COMPRESSOR

(71) Applicant: Robert Bosch GmbH, Stuttgart (DE)

(72) Inventors: Qilin Huang, Shanghai (CN); Chaoqun Zhou, Shanghai (CN); Mingang Wang, Shanghai (CN)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 19/374,018

(22) Filed: Oct. 30, 2025

(65) Prior Publication Data

US 2026/0117772 A1 Apr. 30, 2026

(30) Foreign Application Priority Data

Oct. 30, 2024 (CN) ..... 202422628006.5

(51) Int. Cl.
*F04C 29/00* (2006.01)
*F04C 18/02* (2006.01)

(52) U.S. Cl.
CPC ..... *F04C 29/005* (2013.01); *F04C 18/023* (2013.01); *F04C 18/0246* (2013.01); *F04C 18/0253* (2013.01); *F04C 29/0057* (2013.01)

(58) Field of Classification Search
CPC .. F04C 29/005; F04C 18/023; F04C 18/0246; F04C 18/0253; F04C 29/0057
See application file for complete search history.

(56) References Cited

U.S. PATENT DOCUMENTS 5,090,876 A * 2/1992 Hashizume ..... F04C 18/023 417/410.5
5,165,878 A * 11/1992 Inagaki ..... F04C 18/023 418/55.3
2025/0084844 A1* 3/2025 Sun ..... F04C 18/023

OTHER PUBLICATIONS

Chinese Patent Publication and Machine Translation for CN 111765078 A; 1st Inventor: Hu; Title: Scroll Compressor and Electric Applicane Having the Same; Published Oct. 13, 2020. (Year: 2020).*

* cited by examiner

*Primary Examiner* — Mary A Davis
(74) *Attorney, Agent, or Firm* — Michael Best & Friedrich LLP

(57) ABSTRACT

A co-rotating scroll compressor includes a housing, a first scroll plate, a second scroll plate, and a drive shaft. The first scroll plate rotates around a first rotation axis and includes a first scroll body and a first ring gear. The second scroll plate rotates around a second rotation axis and includes a second scroll body and a second ring gear. The second scroll body is meshed with the first scroll body, and the second rotation axis is parallel to and offset from the first rotation axis. The drive shaft has a first gear and a second gear fixed thereon and coaxial, the first gear is meshed with the first ring gear, the second gear is meshed with the second ring gear, and a gear ratio of the first ring gear to the first gear is equal to a gear ratio of the second ring gear to the second gear.

17 Claims, 7 Drawing Sheets

C-C

C-C

C-C

CO-ROTATING SCROLL COMPRESSOR

BACKGROUND

The present disclosure relates to the technical field of compressors, and more particularly, to a co-rotating scroll compressor.

Scroll compressors are widely used in air conditioning due to their numerous advantages, including high volumetric efficiency, minimal vibration, and low noise. Improvements to existing scroll compressors primarily focus on increasing suction volume and enhancing volumetric efficiency. These compressors typically use a single orbiting scroll and a single fixed scroll, with the medium being compressed by the orbital motion of the orbiting scroll relative to the fixed scroll. However, this design presents several challenges. First, the orbital motion of the orbiting scroll generates eccentric inertia, causing the scroll body of the orbiting scroll to collide with that of the fixed scroll. This reduces the reliability of the scroll body and shortens its service life. Second, to counteract the eccentric inertia of the orbiting scroll, an eccentric block must be placed on the eccentric shaft to compensate for the eccentric dynamic mass. This not only increases the weight of the compressor but also raises energy consumption and complicates the manufacturing and assembly processes. Third, to suppress the self-rotation of the orbiting scroll, allowing it to only orbit in a translational motion, an anti-rotation structure must be implemented. This further adds to the weight of the compressor and complicates its manufacture and assembly.

Therefore, there is an urgent need in the art for a technical solution that leverages the advantages of scroll compressors while effectively addressing the shortcomings of existing scroll compressors.

SUMMARY

In order to solve the problems in the above-mentioned prior art, the present disclosure proposes a co-rotating scroll compressor, which comprises a housing and a first scroll plate, a second scroll plate and a drive shaft rotatably arranged in the housing, wherein the first scroll plate is configured to rotate around a first rotation axis and comprises a first scroll body protruding in the axial direction and a first ring gear arranged in the circumferential direction; wherein the second scroll plate is configured to rotate around a second rotation axis and comprises a second scroll body protruding in the axial direction and a second ring gear arranged in the circumferential direction, the second scroll body is meshed with the first scroll body, and the second rotation axis is parallel to and offset from the first rotation axis; and wherein the drive shaft is provided with a first gear and a second gear fixed thereon and coaxial, the first gear is meshed with the first ring gear, the second gear is meshed with the second ring gear, and the gear ratio of the first ring gear to the first gear is equal to the gear ratio of the second ring gear to the second gear.

According to an optional embodiment of the present disclosure, the co-rotating scroll compressor further comprises a motor arranged within the housing, with a main shaft of the motor coupled to the drive shaft to drive the drive shaft for rotation.

According to an optional embodiment of the present disclosure, the co-rotating scroll compressor further comprises a motor arranged within the housing, with a main shaft of the motor coupled to the second scroll plate to drive the second scroll plate for rotation.

According to an optional embodiment of the present disclosure, the first scroll plate is provided with a through hole that leads to the center of the first scroll body.

According to an optional embodiment of the present disclosure, the first scroll plate further comprises a first plate body and a first ring body that protrudes axially from the first plate body. The first scroll body protrudes axially from the first plate body and is located radially inward of the first ring body. The first ring gear is arranged on the outer periphery of the first ring body.

According to an optional embodiment of the present disclosure, the second scroll body abuts the first plate body. According to an optional embodiment of the present disclosure, the meshing position of the first gear and the first ring gear is radially aligned with the meshing position of the first scroll body and the second scroll body.

According to an optional embodiment of the present disclosure, the first scroll plate further comprises a first plate body, the first scroll body protrudes axially from the first plate body, and the first ring gear is arranged on the outer periphery of the first plate body.

According to an optional embodiment of the present disclosure, the second scroll body abuts the first plate body. According to an optional embodiment of the present disclosure, the second scroll plate further comprises a second plate body, the second scroll body protrudes axially from the second plate body, and the second ring gear is arranged on the outer periphery of the second plate body.

According to an optional embodiment of the present disclosure, the first scroll body abuts the second plate body. According to an optional embodiment of the present disclosure, the co-rotating scroll compressor comprises a plurality of drive shafts uniformly distributed along the circumferential direction.

According to an optional embodiment of the present disclosure, the first gear is a spur gear.

According to an optional embodiment of the present disclosure, the first scroll plate is configured to rotate in a predetermined direction, and the first gear is a helical gear, so that when the first scroll plate rotates in the predetermined direction, the force applied by the first gear to the first ring gear has a component toward the second scroll plate.

According to an optional embodiment of the present disclosure, the second gear is a spur gear.

According to an optional embodiment of the present disclosure, the second scroll plate is configured to rotate in a predetermined direction, and the second gear is a helical gear, so that when the second scroll plate rotates in the predetermined direction, the force applied by the second gear to the second ring gear has a component toward the first scroll plate.

According to an optional embodiment of the present disclosure, the drive shaft is configured to rotate around a third rotation axis, the first rotation axis, the second rotation axis, and the third rotation axis intersect the same radially oriented straight line, and the first rotation axis is located between the second and third rotation axes.

The present disclosure may be embodied as a schematic example in the accompanying drawings. However, it should be noted that the accompanying drawings are merely schematic and that any change contemplated under the teachings of the present disclosure shall be considered to be included within the scope of the present disclosure.

BRIEF DESCRIPTION OF THE DRAWINGS

The accompanying drawings illustrate exemplary examples of the present disclosure.

These accompanying drawings should not be construed as necessarily limiting the scope of the present disclosure, wherein.

DETAILED DESCRIPTION

Further features and advantages of the present disclosure will become more apparent from the following description, which is made with reference to the accompanying drawings. Exemplary examples of the present disclosure are shown in the accompanying drawings, and the various accompanying drawings are not necessarily drawn in actual proportions. However, the present disclosure may be implemented in many different forms and should not be construed as necessarily limiting to the exemplary examples disclosed herein. Rather, these exemplary examples are merely provided for illustrative purposes of the present disclosure and for delivering the spirit and substance of the present disclosure to those skilled in the art.

The present disclosure aims to propose an improved co-rotating scroll compressor. Compared to traditional orbiting scroll compressors, the co-rotating scroll compressor replaces the work process of the medium (such as refrigerants like R744, R134A, R290, etc.) by the orbital motion of one scroll plate relative to the other with the self-rotation of the two scroll plates around their respective rotation axes. This design avoids the eccentric inertia caused by the orbital motion of the scroll plates, thereby reducing the lateral impact on the scroll bodies of the two scroll plates due to the eccentric inertia. As a result, the reliability of the scroll bodies is improved, and their service life is extended. In addition, the co-rotating scroll compressor according to the present disclosure does not need to set an eccentric block to overcome the eccentric inertia, thereby simplifying the overall structure of the compressor. Moreover, since the orbital translational motion is replaced by the self-rotation motion around their respective rotation axes with higher stability, the dynamic performance of the co-rotating scroll compressor is also significantly improved. In particular, in addition to the advantages mentioned above, in some specific embodiments, the co-rotating scroll compressor according to the present disclosure can also offer several benefits. These include reliably ensuring that the two scroll plates rotate in the same direction and at the same speed, as well as effectively suppressing the axial gap and radial offset between the two scroll plates.

Various optional but non-limiting embodiments of a co-rotating scroll compressor according to the present disclosure are described in detail below with reference to the accompanying drawings. It should be noted that, among the terms used herein to indicate the relative orientations of various components, "axial" refers to a direction coincident with or parallel to the axis of rotation, "radial" refers to a direction perpendicular to the axis of rotation, and "circumferential" refers to a direction around the axis of rotation. Unless otherwise expressly stated, these terms indicating relative orientations have their usual meanings in the art.

Figure 1:
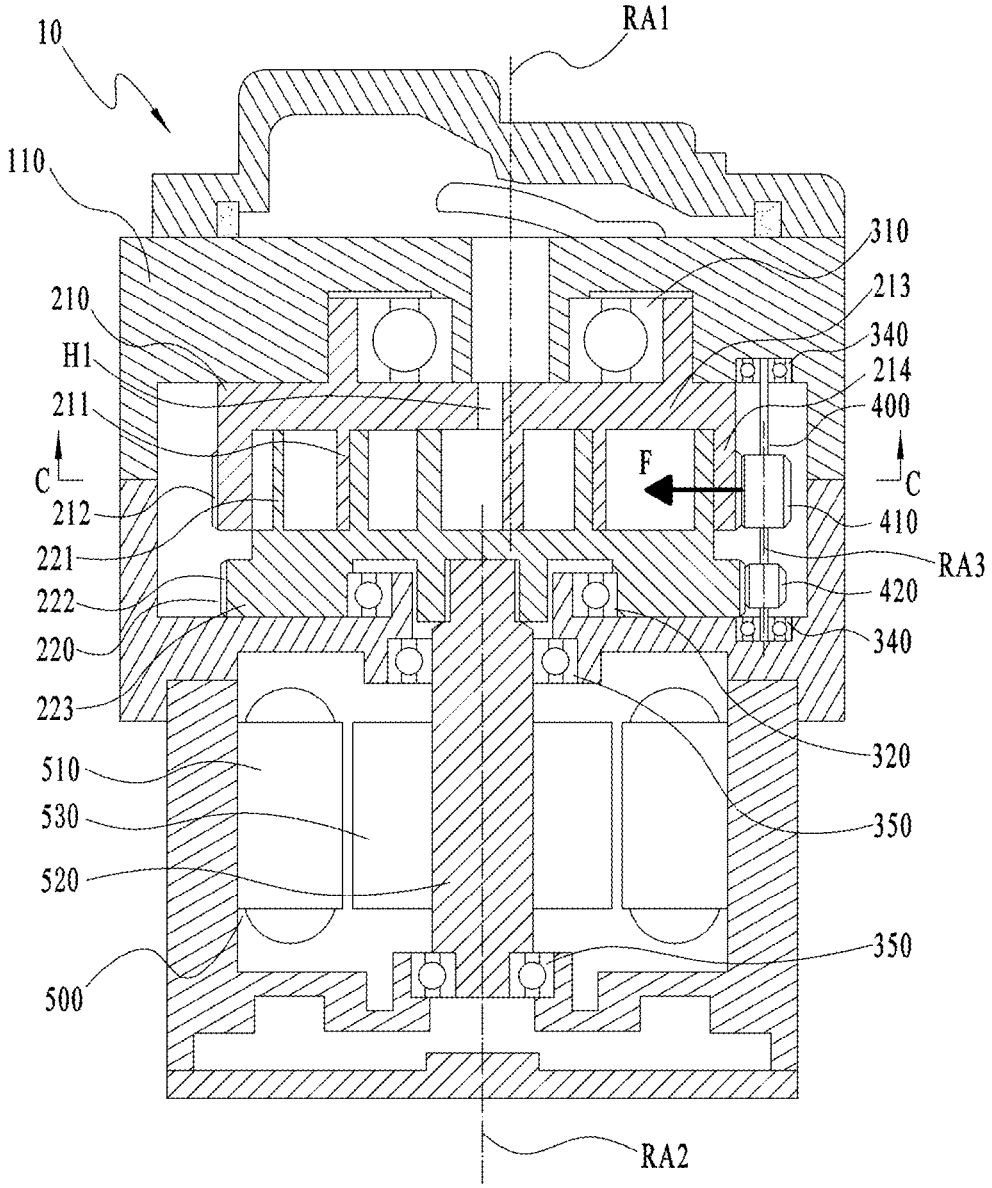
FIG. 1 is a schematic cross-sectional view of a co-rotating scroll compressor according to one embodiment of the present disclosure.

Referring to FIG. 1, a schematic cross-sectional view of a co-rotating scroll compressor according to an embodiment of the present disclosure is shown. As shown in FIG. 1, the co-rotating scroll compressor 10 comprises a housing 110 and a first scroll plate 210 and a second scroll plate 220 rotatably arranged in the housing 110. Specifically, the first scroll plate 210 is configured to rotate around a first rotation axis RA1 and comprises a first scroll body 211 protruding in the axial direction and a first ring gear 212 arranged around the first rotation axis RA1, wherein the first scroll body 211 has a spiral or vortex shape when viewed in the axial direction and extends from the outer periphery or periphery of the first scroll plate 210 toward the center along the vortex direction, and the first ring gear 212 may be arranged on the outer periphery or periphery of the first scroll plate 210. In particular, the first rotation axis RA1 may be defined by a first scroll plate bearing 310 fixed within the housing 110 and used to rotatably support the first scroll plate 210. The second scroll plate 220 is configured to rotate around a second rotation axis RA2, and comprises a second scroll body 221 protruding in the axial direction and a second ring gear 222 arranged around the second rotation axis RA2, wherein the second scroll body 221 also has a spiral or vortex shape when viewed in the axial direction and extends from the outer periphery or periphery of the second scroll plate 220 toward the center along the vortex direction, the second ring gear 222 may be arranged on the outer periphery or periphery of the second scroll plate 220, and the second rotation axis RA2 is parallel to and offset relative to the first rotation axis RA1. In particular, the second rotation axis RA2 may be defined by a second scroll plate bearing 320 fixed within the housing 110 and used to rotatably support the second scroll plate 220. In addition, as shown in FIG. 1, the first scroll plate 210 and the second scroll plate 220 are positioned so that the side surface of the first scroll body 211 and the side surface of the second scroll body 221 are engaged with each other, so that the first scroll body 211 and the second scroll body 221 cooperate or mesh with each other, so that a plurality of compression chambers are defined between the two scroll bodies as described in more detail below, and these compression chambers are arranged along the vortex direction and separated from each other, and the volume of each compression chamber decreases as it approaches the center of the two scroll bodies.

Continuing with reference to FIG. 1, the co-rotating scroll compressor 10 further comprises a drive shaft 400 which is rotatably arranged in the housing 110 and is provided with a first gear 410 and a second gear 420, wherein the first gear 410 and the second gear 420 are coaxially arranged and are both fixed on the drive shaft 400, so that the drive shaft 400, the first gear 410 and the second gear 420 are configured to rotate around a third rotation axis RA3 at the same speed and in the same direction, wherein the third rotation axis RA3 is parallel to and offset relative to each of the first rotation axis RA1 and the second rotation axis RA2, and in particular, the third rotation axis RA3 may be defined by two drive shaft bearings 340 fixed in the housing 110 and used to rotatably support the drive shaft 400, and the two drive shaft bearings 340 are positioned at both ends of the drive shaft 400. Furthermore, as shown in FIG. 1, the first gear 410 meshes with the first ring gear 212 of the first scroll plate 210, and the second gear 420 meshes with the second ring gear 222 of the second scroll plate 220. Furthermore, the gear ratio of the first ring gear 212 to the first gear 410 (i.e., the number of teeth on the first ring gear 212/the number of teeth on the first gear 410) is equal to the gear ratio of the second ring gear 222 to the second gear 420 (i.e., the number of teeth on the second ring gear 222/the number of teeth on the second gear 420). In this configuration, the drive shaft 400, via the first gear 410 and the second gear 420, ensures that the first scroll plate 210 and the second scroll plate 220 rotate at the same speed and in the same direction around their respective axes of rotation. Consequently, the compression chambers defined between the first scroll body 211 and the second scroll body 221, move toward the centers of the two scroll bodies as the two scroll plates rotate, gradually decreasing in volume, thereby completing the compression process of the medium, as described in more detail below.

As the first scroll plate 210 rotates around the first rotation axis RA1 and the second scroll plate 220 rotates around the second rotation axis RA2 at the same speed and in the same direction, each compression chamber moves along the vortex direction toward the center of the two scroll bodies while its volume gradually decreases, which causes the medium in each compression chamber to be pushed toward the center of the two scroll bodies and gradually compressed, thereby causing the pressure of the medium to gradually increase and reach a maximum when the medium moves to the center of the two scroll bodies, thereby achieving a compression process of the medium. Of course, in the embodiment shown in FIG. 1, in order to discharge the compressed medium at the center of the two scroll bodies, the first scroll plate 210 is provided with a through hole H1 which extends through the first scroll plate 210 and leads to the center of the first scroll body 211, thereby allowing the medium at the center of the two scroll bodies to be discharged through the through hole H1.

Figure 2:
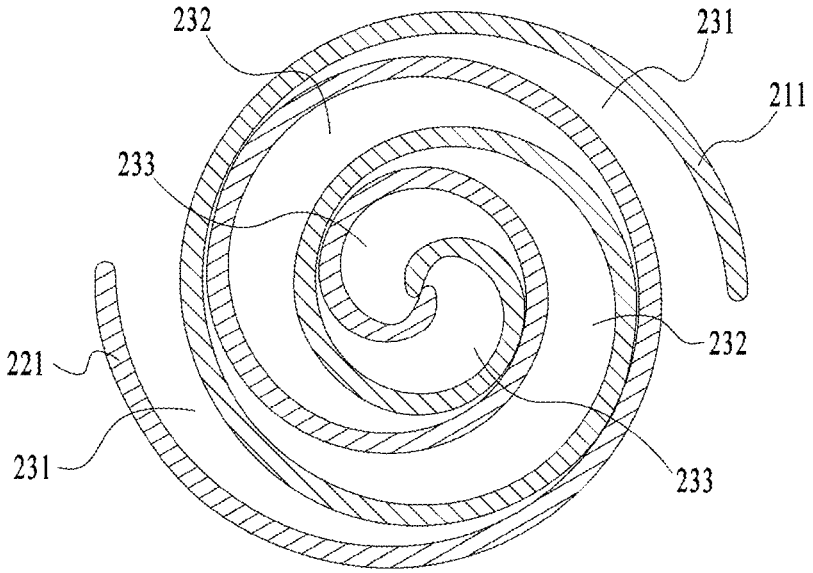
FIG. 2 is a schematic cross-sectional view of a first scroll body and a second scroll body of the co-rotating scroll compressor shown in FIG. 1 in a first position.
Figure 3:
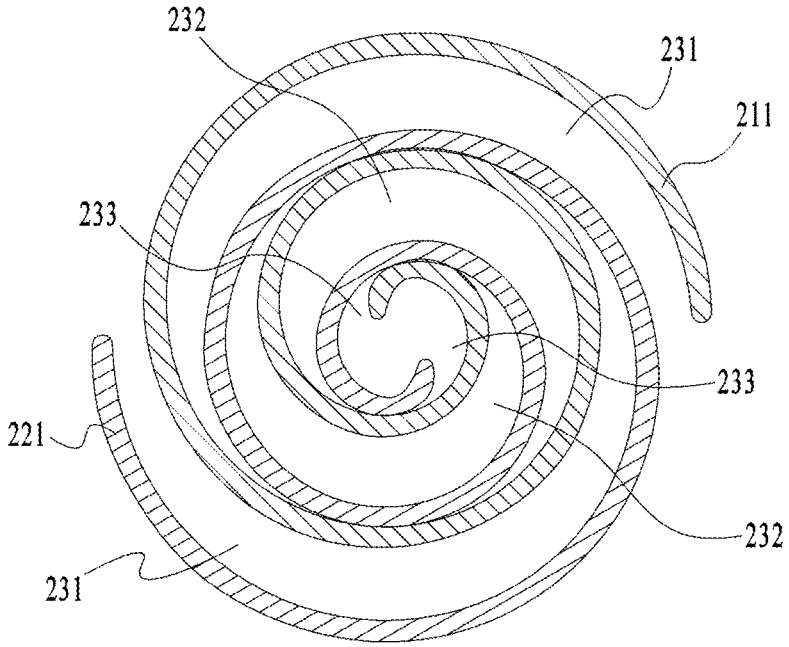
FIG. 3 is a schematic cross-sectional view of a first scroll body and a second scroll body of the co-rotating scroll compressor shown in FIG. 1 in a second position.
Figure 4:
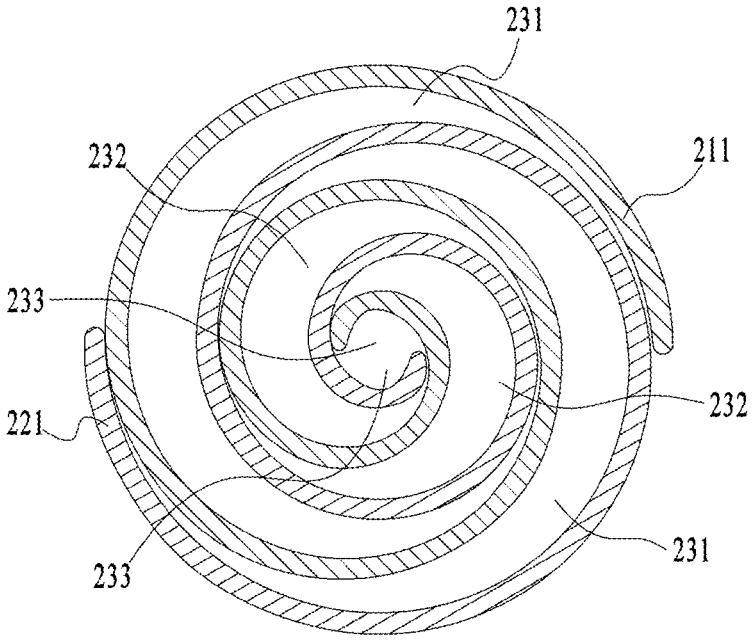
FIG. 4 is a schematic cross-sectional view of a first scroll body and a second scroll body of the co-rotating scroll compressor shown in FIG. 1 in a third position.

In order to make the above compression process more intuitive, the following description will be made with reference to the cross-sectional view of the first scroll body 211 and the second scroll body 221. Referring to FIGS. 2-4, schematic cross-sectional views of the first scroll body 211 and the second scroll body 221 at different rotational positions are shown. As shown in FIGS. 2-4, the first scroll body 211 and the second scroll body 221 define two groups of compression chambers arranged symmetrically about the center of the two scroll bodies between each other, wherein each group of compression chambers comprises a first compression chamber 231, a second compression chamber 232 and a third compression chamber 233 arranged from outside to inside along the vortex direction and isolated from each other. When the two scroll bodies are in the first position shown in FIG. 2, the first compression chamber 231 is open to allow the medium to be compressed to enter the first compression chamber 231, while the second compression chamber 232 and the third compression chamber 233 that have already accommodated the medium are closed. When the two scroll bodies rotate respectively from the first position shown in FIG. 2 to the second position shown in FIG. 3, the first compression chamber 231 moves toward the center of the two scroll bodies and begins to close, the second compression chamber 232 moves toward the center of the two scroll bodies and decreases in volume, and the third compression chamber 233 reaches the center of the two scroll bodies and decreases in volume, so that the medium in each compression chamber is pushed toward the center of the two scroll bodies and compressed. When the two scroll bodies further rotate respectively from the second position shown in FIG. 3 to the third position shown in FIG. 4, the first compression chamber 231 moves further toward the center of the two scroll bodies and completely closes, the second compression chamber 232 moves further toward the center of the two scroll bodies and decreases in volume, and the third compression chamber 233 remains at the center of the two scroll bodies but its volume decreases further, so that the medium in each compression chamber is pushed further toward the center of the two scroll bodies and further compressed. As the two scroll bodies further rotate respectively from the third position shown in FIG. 4 back to the first position shown in FIG. 2, the third compression chamber 233 disappears, thereby discharging the compressed medium. The second compression chamber 232 becomes the new third compression chamber 233, and the first compression chamber 231 becomes the new second compression chamber 232. A new first compression chamber 231 is generated, thereby ending the previous compression process and starting a new one. As the two scroll plates rotate, the above compression process is repeated, allowing the two scroll bodies to continuously suction, move, compress, and discharge the medium.

Under the above configuration, the compression process is achieved by the two scroll plates rotating at the same speed and in the same direction around their respective rotation axes, rather than through the orbital motion (also known as translational motion) of either scroll plate. Therefore, neither scroll plate generates eccentric inertia due to orbital motion, which prevents the two scroll bodies from colliding with each other due to eccentric inertia, thereby extending the service life of the scroll bodies and improving their reliability. Furthermore, there is no need to provide an eccentric block to overcome eccentric inertia, nor is there a need to provide an anti-rotation structure to suppress the self-rotation of the scroll plates. This simplifies the overall structure of the compressor and improves its reliability. Furthermore, since the orbital motion is replaced by a more stable rotational motion, the dynamic performance of the compressor is significantly improved. Furthermore, since the drive shaft 400 may effectively ensure that the two scroll plates rotate at the same speed and in the same direction around their respective rotation axes, the above compression process can be carried out in a more reliable and stable manner, further improving the reliability of the compressor.

Returning to FIG. 1, the co-rotating scroll compressor 10 further comprises a motor 500 arranged in the housing 110, wherein the motor 500 comprises a stator 510 fixed in the housing 110, a main shaft 520 rotatably arranged in the housing 110 and located radially inside the stator 510, and a rotor 530 fixed on the main shaft 520, wherein the stator 510 is configured to generate a rotating magnetic field after being energized, and the rotor 530 is configured to couple with the rotating magnetic field generated by the stator 510 through magnetic flux, thereby driving the main shaft 520 to rotate together under the drive of the rotating magnetic field, and in particular, the main shaft 520 may be rotatably supported by two main shaft bearings 350 fixed in the housing 110, and the two main shaft bearings 350 are positioned at both ends of the main shaft 520. Furthermore, as shown in FIG. 1, the main shaft 520 is configured to rotate around the second rotation axis RA2 and is coupled to the second scroll plate 220 on a side opposite the second scroll body 221 (e.g., via a keyway) to drive the second scroll plate 220 to rotate around the second rotation axis RA2. In this configuration, after being energized, the motor 500 drives the second scroll plate 220 to rotate around the second rotation axis RA2 through the main shaft 520, the second scroll plate 220 drives the drive shaft 400 to rotate around the third rotation axis RA3 through the second ring gear 222 and the second gear 420, and the drive shaft 400 drives the first scroll plate 210 to rotate around the first rotation axis RA1 through the first gear 410 and the first ring gear 212, thereby completing the above-mentioned compression process. Of course, the above embodiment is merely exemplary. In embodiments not shown, the co-rotating scroll compressor 10 may not comprise the motor 500, but may be driven by an external motor. The main shaft 520 may not be coupled to any scroll plate, but may be coupled to the drive shaft 400 so as to drive the two scroll plates to rotate around their respective rotation axes through the drive shaft 400. Therefore, any coupling method of the motor 500 with the two scroll plates and the drive shaft 400 falls within the scope of protection of this disclosure.

Continuing with reference to FIG. 1, the first scroll plate 210 further comprises a first plate body 213 that is generally plate-shaped and a first ring body 214 that is generally cylindrical and protrudes from the first plate body 213 in the axial direction along the outer periphery or periphery of the first plate body 213, wherein the first scroll body 211 protrudes from the first plate body 213 and is located radially inside the first ring body 214, so that the first ring body 214 surrounds the first scroll body 211, and the first ring gear 212 is arranged on the outer periphery or periphery of the first ring body 214. The second scroll plate 220 further comprises a second plate body 223 having a generally plate shape, wherein a second scroll body 221 protrudes from the second plate body 223 in the axial direction, and a second ring gear 222 is arranged on an outer periphery or periphery of the second plate body 223. In this configuration, since the first ring gear 212 is arranged on the outer periphery or periphery of the first ring body 214 instead of being arranged on the outer periphery or periphery of the first plate body 213, the position of the first ring gear 212 and the position of the first gear 410 meshing with the first ring gear 212 are no longer restricted by the position of the first plate body 213, thereby allowing the first ring gear 212 and the first gear 410 to be positioned so that the meshing position of the first ring gear 212 and the first gear 410 may be aligned in the radial direction with the meshing position of the first scroll body 211 and the second scroll body 221. That is, the meshing position of the first ring gear 212 and the first gear 410 and the meshing position of the first scroll body 211 and the second scroll body 221 are at the same level in the axial direction. Furthermore, the first scroll plate 210, the second scroll plate 220, and the drive shaft 400 may be positioned so that the first rotation axis RA1, the second rotation axis RA2, and the third rotation axis RA3 are intersected by or intersect the same radially oriented straight line, with the first rotation axis RA1 located between the second rotation axis RA2 and the third rotation axis RA3. In this configuration, the first scroll plate 210 is clamped in the radial direction between the second scroll plate 220 and the drive shaft 400, so that the radial component force F (as shown by the arrow in FIG. 1) exerted on the first ring gear 212 when the first ring gear 212 is engaged with the first gear 410 is applied to the side of the profile when the first scroll body 211 and the second scroll body 221 are engaged, and points to the center of the first scroll body 211 and the second scroll body 221, thereby reducing the overturning of the first scroll body 211 and the second scroll body 221, thereby reducing the tangential leakage of the medium. In addition, as shown in FIG. 1, the first scroll body 211 abuts against the second plate body 223, and the second scroll body 221 abuts against the first plate body 213, thereby eliminating the axial gap between the first scroll plate 210 and the second scroll plate 220 that may cause axial leakage of the medium in each compression chamber, thereby ensuring the working efficiency of the compressor.

Figure 5:
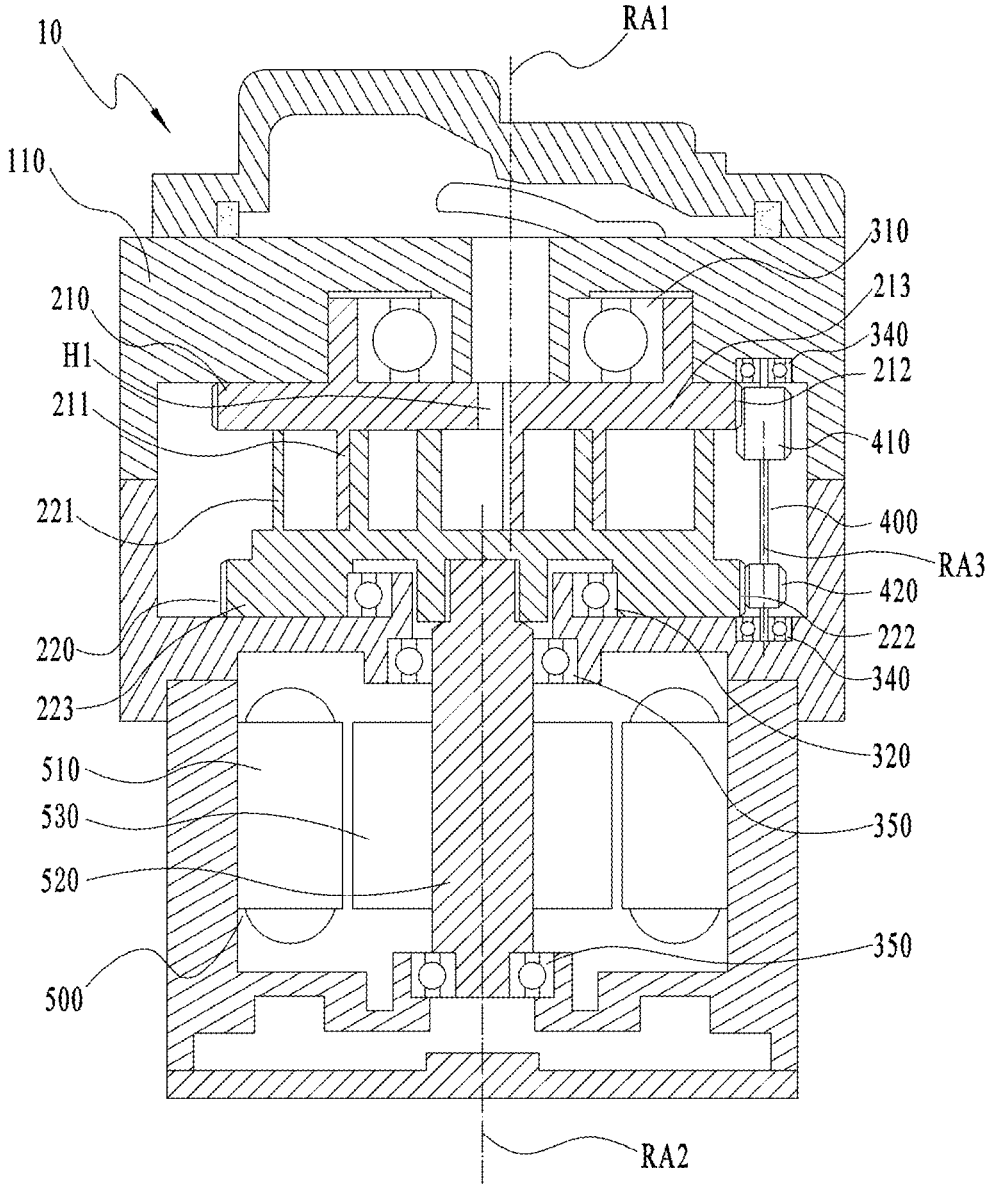
FIG. 5 is a schematic cross-sectional view of a co-rotating scroll compressor according to another embodiment of the present disclosure.

Referring to FIG. 5, a schematic cross-sectional view of a co-rotating scroll compressor according to another embodiment of the present disclosure is shown. The main difference between the embodiment shown in FIG. 5 and the embodiment shown in FIG. 1 is that the first scroll plate 210 does not comprise the first ring body 214, and the first ring gear 212 is arranged on the outer periphery or periphery of the first plate body 213. In this configuration, the first ring gear 212 and the first gear 410, as well as the second ring gear 222 and the second gear 420, may be arranged to be adjacent to the two drive shaft bearings 340 at both ends of the drive shaft 400, respectively. This enables the two drive shaft bearings 340 to more effectively suppress the radial displacement of the first ring gear 212 and the first gear 410, as well as the second ring gear 222 and the second gear 420, thereby ensuring that the first ring gear 212 and the first gear 410, as well as the second ring gear 222 and the second gear 420 can be reliably engaged together, which more reliably ensures the smooth operation of the compressor and further improves its dynamic performance.

Figure 6:
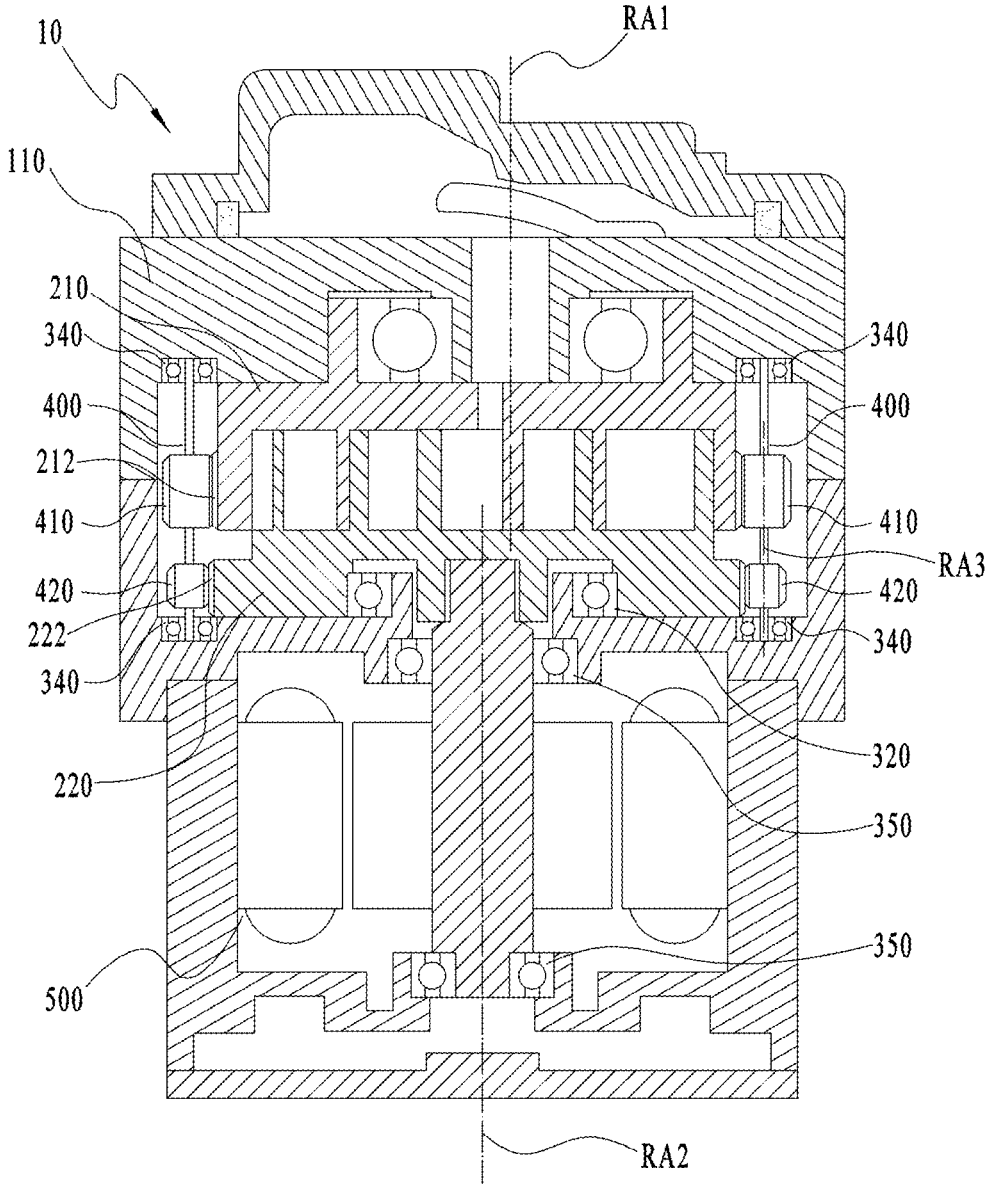
FIG. 6 is a schematic cross-sectional view of a co-rotating scroll compressor according to yet another embodiment of the present disclosure.

Referring to FIG. 6, a schematic cross-sectional view of a co-rotating scroll compressor according to yet another embodiment of the present disclosure is shown. The main difference between the embodiment shown in FIG. 6 and the embodiment shown in FIG. 1 and FIG. 5 is that, in the embodiment shown in FIG. 1 and FIG. 5, the co-rotating scroll compressor 10 comprises only one drive shaft 400, while in the embodiment shown in FIG. 6, the co-rotating scroll compressor 10 may comprise two or more drive shafts 400 rotatably arranged in the housing 110, and these drive shafts 400 may be uniformly distributed around the first rotation axis RA1 or the second rotation axis RA2 (i.e., along the circumferential direction), and each of these drive shafts 400 is rotatably arranged in the housing 110 and is provided with a first gear 410 and a second gear 420 fixed thereon, wherein the first ring gear 212 is engaged with each first gear 410 and has the same gear ratio with each first gear 410, the second ring gear 222 is engaged with each second gear 420 and has the same gear ratio with each second gear 420, and the gear ratio of the first ring gear 212 to each first gear 410 is equal to the gear ratio of the second ring gear 222 to each second gear 420. In this configuration, compared to a single drive shaft, a plurality of drive shafts may more reliably ensure that the two scroll plates rotate at the same speed and in the same direction, and a single drive shaft may cause the two scroll plates to displace away from the drive shaft, while a plurality of drive shafts uniformly distributed along the circumferential direction may effectively suppress this radial displacement of the two scroll plates, thereby ensuring that the two ring gears can reliably engage with each gear. Therefore, the above configuration further improves the reliability and dynamic performance of the compressor.

In the embodiment described above with reference to the drawings, the first gear 410 is a spur gear and the first ring gear 212 is a spur gear meshing therewith, and the second gear 420 is a spur gear and the second ring gear 222 is a spur gear meshing therewith. However, this is merely exemplary.

Figure 7:
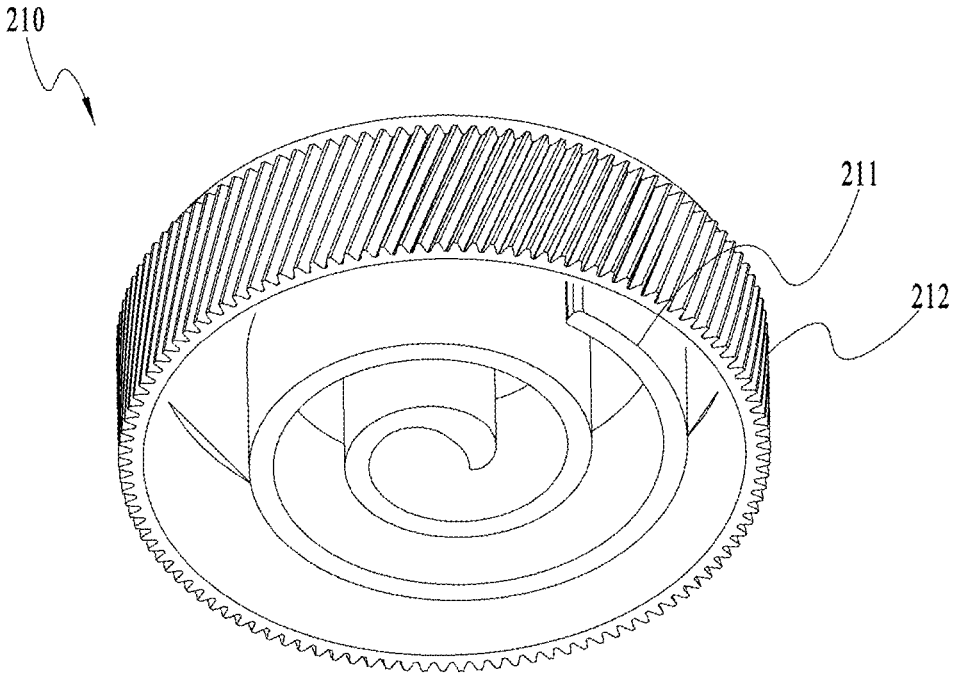
FIG. 7 is a schematic perspective view of a first scroll plate of a co-rotating scroll compressor according to yet another embodiment of the present disclosure.

For example, referring to FIG. 7, there is shown a schematic perspective view of a first scroll plate of a co-rotating scroll compressor according to yet another embodiment of the present disclosure, in which first ring gear 212 is a helical ring gear. In this embodiment, the first scroll plate 210 and the second scroll plate 220 are configured to rotate in a predetermined direction to compress the medium, and wherein the first gear 410 is a helical gear, the first ring gear 212 is a helical ring gear meshing therewith, and the teeth of the first gear 410 are tilted in such a direction that: when the first scroll plate 210 rotates in the predetermined direction, the force applied by the teeth to the first ring gear 212 has a component toward the second scroll plate 220; and/or the second gear 420 is a helical gear, the second ring gear 222 is a helical ring gear meshing therewith, and the teeth of the second gear 420 are tilted in such a direction that: when the second scroll plate 220 rotates in the predetermined direction, the force applied by these teeth to the second ring gear 222 has a component toward the first scroll plate 210. Specifically, the helix angles of the first ring gear 212 and the second ring gear 222 may both be right-handed, while the helix angles of the first gear 410 and the second gear 420 may both be left-handed. In this configuration, the first scroll plate 210 and the second scroll plate 220 may be pressed toward each other by the first gear 410 and/or the second gear 420, thereby avoiding an axial gap therebetween that causes axial leakage of the medium, thereby more reliably ensuring the operating efficiency of the compressor.

The above optional but non-limiting examples of a co-rotating scroll compressor according to the present disclosure are described in detail above with reference the accompanying drawings. For those skilled in the art, without departing from the spirit and substance of the present disclosure, modifications and additions to techniques and structures and recombination of features in various examples shall clearly be considered to be included within the scope of the present disclosure. As a result, these modifications and supplements that may be conceived under the guidance of the present disclosure shall be considered as a part of the present disclosure. The scope of the present disclosure includes known equivalent technologies and equivalent technologies not yet foreseen as of the filing date of this disclosure.

The invention claimed is:

1. A co-rotating scroll compressor, comprising: a housing (110), a first scroll plate (210), a second scroll plate (220), and a drive shaft (400) rotatably arranged within the housing (110), wherein the first scroll plate (210) is configured to rotate around a first rotation axis (RA1) and comprises a first scroll body (211) protruding in an axial direction and a first ring gear (212) arranged in a circumferential direction;

wherein the second scroll plate (220) is configured to rotate around a second rotation axis (RA2) and comprises a second scroll body (221) protruding in the axial direction and a second ring gear (222) arranged in the circumferential direction, wherein the second scroll body (221) is meshed with the first scroll body (211), and the second rotation axis (RA2) and the first rotation axis (RA1) are parallel to and offset from each other; and wherein the drive shaft (400) is provided with a first gear (410) and a second gear (420) fixed thereto and coaxially arranged, the first gear (410) being meshed with the first ring gear (212), the second gear (420) being meshed with the second ring gear (222), and a gear ratio of the first ring gear (212) to the first gear (410) being equal to a gear ratio of the second ring gear (222) to the second gear (420).

2. The co-rotating scroll compressor according to claim 1, further comprising a motor (500) arranged within the housing (110), wherein a main shaft (520) of the motor (500) is coupled to the drive shaft (400) to drive the drive shaft (400) to rotate.

3. The co-rotating scroll compressor according to claim 1, further comprising a motor (500) arranged within the housing (110), wherein a main shaft (520) of the motor (500) is coupled to the second scroll plate (220) to drive the second scroll plate (220) to rotate.

4. The co-rotating scroll compressor according to claim 3, wherein the first scroll plate (210) is provided with a through hole (H1), wherein the through hole (H1) leads to a center of the first scroll body (211).

5. The co-rotating scroll compressor according to claim 1, wherein the first scroll plate (210) further comprises a first plate body (213) and a first ring body (214) protruding axially from the first plate body (213), the first scroll body (211) protruding axially from the first plate body (213) and located radially inward of the first ring body (214), and the first ring gear (212) is arranged on an outer periphery of the first ring body (214).

6. The co-rotating scroll compressor according to claim 5, wherein the second scroll body (221) abuts against the first plate body (213).

7. The co-rotating scroll compressor according to claim 5, wherein a meshing position of the first gear (410) and the first ring gear (212) is radially aligned with a meshing position of the first scroll body (211) and the second scroll body (221).

8. The co-rotating scroll compressor according to claim 1, wherein the first scroll plate (210) further comprises a first plate body (213), wherein the first scroll body (211) protrudes axially from the first plate body (213), and the first ring gear (212) is arranged on an outer periphery of the first plate body (213).

9. The co-rotating scroll compressor according to claim 8, wherein the second scroll body (221) abuts against the first plate body (213).

10. The co-rotating scroll compressor according to claim 1, wherein the second scroll plate (220) further comprises a second plate body (223), wherein the second scroll body (221) protrudes axially from the second plate body (223), and the second ring gear (222) is arranged on an outer periphery of the second plate body (223).

11. The co-rotating scroll compressor according to claim 10, wherein the first scroll body (211) abuts against the second plate body (223).

12. The co-rotating scroll compressor according to claim 1, further comprising a plurality of drive shafts (400) uniformly distributed along the circumferential direction.

13. The co-rotating scroll compressor according to claim 1, wherein the first gear (410) is a spur gear.

14. The co-rotating scroll compressor according to claim 1, wherein the first scroll plate (210) is configured to rotate in a predetermined direction, and the first gear (410) is a helical gear so that when the first scroll plate (210) rotates in the predetermined direction, a force applied by the first gear (410) to the first ring gear (212) has a component toward the second scroll plate (220).

15. The co-rotating scroll compressor according to claim 1, wherein the second gear (420) is a spur gear.

16. The co-rotating scroll compressor according to claim 1, wherein the second scroll plate (220) is configured to rotate in a predetermined direction, and the second gear (420) is a helical gear so that when the second scroll plate (220) rotates in the predetermined direction, a force applied by the second gear (420) to the second ring gear (222) has a component toward the first scroll plate (210).

17. The co-rotating scroll compressor according to claim 1, wherein the drive shaft (400) is configured to rotate around a third rotation axis (RA3), the first rotation axis (RA1), the second rotation axis (RA2) and the third rotation axis (RA3) intersect with a same radially oriented straight line, and the first rotation axis (RA1) is located between the second rotation axis (RA2) and the third rotation axis (RA3).

* * * * *